US009086188B2

(12) United States Patent
Lee et al.

(10) Patent No.: US 9,086,188 B2
(45) Date of Patent: Jul. 21, 2015

(54) METHOD AND SYSTEM FOR REDUCING HEATING VALUE OF NATURAL GAS

(75) Inventors: Jung Han Lee, Geoje-si (KR); Young Sik Moon, Geoje-si (KR); Dong Kyu Choi, Geoje-si (KR); Young Soo Kim, Geoje-si (KR); Jong Hyun Park, Geoje-si (KR)

(73) Assignee: DAEWOO SHIPBUILDING & MARINE ENGINEERING CO., LTD., Seoul (KR)

( * ) Notice: Subject to any disclaimer, the term of this patent is extended or adjusted under 35 U.S.C. 154(b) by 1880 days.

(21) Appl. No.: 12/176,619

(22) Filed: Jul. 21, 2008

(65) Prior Publication Data

US 2009/0259081 A1 Oct. 15, 2009

(30) Foreign Application Priority Data

Apr. 10, 2008 (KR) ..... 10-2008-0033279

(51) Int. Cl.

| | |
|---|---|
| ***F17C 9/02*** | (2006.01) |
| ***F17C 9/04*** | (2006.01) |
| ***F25J 1/02*** | (2006.01) |
| ***C10L 3/10*** | (2006.01) |
| ***F25J 3/06*** | (2006.01) |
| *F02D 19/06* | (2006.01) |
| *B63J 99/00* | (2009.01) |

(52) U.S. Cl.

CPC ... *F17C 9/02* (2013.01); *C10L 3/10* (2013.01); *F17C 9/04* (2013.01); *F25J 1/023* (2013.01); *F25J 3/064* (2013.01); *F25J 3/0615* (2013.01); *F25J 3/0635* (2013.01); *B63J 2099/003* (2013.01); *F02D 19/0647* (2013.01); *F17C2260/056* (2013.01); *F25J 2210/42* (2013.01); *F25J 2215/02* (2013.01); *F25J 2290/72* (2013.01)

(58) Field of Classification Search

USPC ..... 62/618, 50.2, 53.2, 616, 614

See application file for complete search history.

(56) References Cited

U.S. PATENT DOCUMENTS

| | | | |
|---|---|---|---|
| 2,952,984 | A | 9/1960 | Marshall, Jr. |
| 3,282,060 | A | 11/1966 | Hays |

(Continued)

FOREIGN PATENT DOCUMENTS

| | | | |
|---|---|---|---|
| CN | 85105351 | A | 4/1987 |
| EP | 0293832 | A2 | 12/1988 |

(Continued)

OTHER PUBLICATIONS

International Code for the Construction and Equipment of Ships Carrying Liquefied Gases in Bulk (IGC Code), 1993, pp. 31-34, IMO, London.

(Continued)

*Primary Examiner* — John F Pettitt

(74) *Attorney, Agent, or Firm* — Knobbe Martens Olson & Bear, LLP

(57) ABSTRACT

Disclosed is a system for reducing a heating value of natural gas. The system includes a heat exchanger to liquefy a portion of components having high heating values, a gas-liquid separator to separate the liquefied component, and a nitrogen adding mechanism to add nitrogen to remaining non-liquefied components. The system includes an additional heat exchanger to cool and liquefy the remaining non-liquefied components after the gas-liquid separator separates the liquefied component from the natural gas. The heat exchangers employ cold heat generated upon regasification of LNG. The system can reduce the heating value of natural gas composed of a variety of hydrocarbon components according to requirements of a place of demand by separating the component with the higher heating value from the natural gas to allow the separated component to be used as fuel, thereby reducing an overall size and operating costs of the system.

11 Claims, 1 Drawing Sheet

(56) References Cited

U.S. PATENT DOCUMENTS

| | | | | |
|---|---|---|---|---|
| 3,407,052 | A | 10/1968 | Huntress et al. | |
| 3,420,068 | A | 1/1969 | Petit | |
| 3,434,492 | A | 3/1969 | Yearwood et al. | |
| 3,453,836 | A | 7/1969 | Kerr | |
| 3,527,585 | A * | 9/1970 | Ungerleider | 48/127.3 |
| 3,763,658 | A | 10/1973 | Gaumer, Jr. et al. | |
| 3,837,172 | A | 9/1974 | Markbreiter et al. | |
| 3,837,821 | A | 9/1974 | Buffiere et al. | |
| 3,857,245 | A | 12/1974 | Jones | |
| 3,874,185 | A | 4/1975 | Etzbach | |
| 3,886,758 | A | 6/1975 | Perrotin et al. | |
| 3,919,852 | A | 11/1975 | Jones | |
| 4,033,135 | A | 7/1977 | Mandrin | |
| 4,041,721 | A | 8/1977 | Kniel | |
| 4,054,433 | A | 10/1977 | Buffiere et al. | |
| 4,065,278 | A | 12/1977 | Newton et al. | |
| 4,083,318 | A | 4/1978 | Verolme | |
| 4,095,546 | A | 6/1978 | Kane | |
| 4,129,432 | A | 12/1978 | Garside | |
| 4,315,408 | A | 2/1982 | Karl | |
| 4,382,524 | A | 5/1983 | Kvamsdal | |
| 4,598,554 | A | 7/1986 | Bastian | |
| 4,826,354 | A | 5/1989 | Adorjan | |
| 4,846,862 | A | 7/1989 | Cook | |
| 5,114,451 | A | 5/1992 | Rambo et al. | |
| 5,137,558 | A | 8/1992 | Agrawal | |
| 5,139,547 | A | 8/1992 | Agrawal et al. | |
| 5,226,931 | A | 7/1993 | Combier | |
| 5,325,673 | A | 7/1994 | Durr et al. | |
| 5,373,702 | A | 12/1994 | Kalet et al. | |
| 5,375,547 | A | 12/1994 | Abe et al. | |
| 5,531,178 | A | 7/1996 | Abe et al. | |
| 5,542,255 | A | 8/1996 | Preston et al. | |
| 5,586,513 | A | 12/1996 | Jean et al. | |
| 5,685,159 | A | 11/1997 | Kooy et al. | |
| 5,727,492 | A | 3/1998 | Cuneo et al. | |
| 6,023,942 | A | 2/2000 | Thomas et al. | |
| 6,035,795 | A | 3/2000 | Dhellemmes et al. | |
| 6,089,022 | A | 7/2000 | Zednik et al. | |
| 6,237,347 | B1 | 5/2001 | Rigby et al. | |
| 6,378,722 | B1 | 4/2002 | Dhellemmes | |
| 6,530,241 | B2 | 3/2003 | Pozivil | |
| 6,564,579 | B1 | 5/2003 | McCartney | |
| 6,732,881 | B1 | 5/2004 | Gulati | |
| 6,829,901 | B2 | 12/2004 | Harley et al. | |
| 6,964,181 | B1 | 11/2005 | Milios et al. | |
| 7,100,261 | B2 | 9/2006 | Gulati | |
| 7,322,387 | B2 | 1/2008 | Landry et al. | |
| 7,404,301 | B2 | 7/2008 | Huang et al. | |
| 7,448,223 | B2 | 11/2008 | Darling, IV et al. | |
| 7,464,734 | B2 | 12/2008 | Liu | |
| 7,644,676 | B2 | 1/2010 | Lee et al. | |
| 7,726,359 | B2 | 6/2010 | Hartono et al. | |
| 7,841,288 | B2 | 11/2010 | Lee et al. | |
| 8,028,724 | B2 | 10/2011 | Lee et al. | |
| 2001/0042377 | A1 | 11/2001 | Pozivil | |
| 2003/0000949 | A1 | 1/2003 | Dhellemmes | |
| 2005/0016185 | A1 | 1/2005 | Emmer et al. | |
| 2005/0042035 | A1 | 2/2005 | de Baan | |
| 2005/0126220 | A1 | 6/2005 | Ward | |
| 2006/0053806 | A1 | 3/2006 | Tassel | |
| 2006/0156744 | A1 * | 7/2006 | Cusiter et al. | 62/50.2 |
| 2007/0125122 | A1 | 6/2007 | Mak et al. | |
| 2007/0128957 | A1 | 6/2007 | Korsgaard | |
| 2007/0149838 | A1 | 6/2007 | Chretien | |
| 2008/0127673 | A1 | 6/2008 | Bowen et al. | |
| 2008/0148771 | A1 | 6/2008 | Yengle et al. | |
| 2008/0190117 | A1 | 8/2008 | Lee et al. | |
| 2008/0190118 | A1 | 8/2008 | Lee et al. | |
| 2008/0190352 | A1 | 8/2008 | Lee et al. | |
| 2008/0245101 | A1 | 10/2008 | Dubettier-Grenier et al. | |
| 2008/0264100 | A1 * | 10/2008 | Mak et al. | 62/618 |
| 2009/0199591 | A1 | 8/2009 | Lee et al. | |
| 2009/0211262 | A1 | 8/2009 | Lee et al. | |
| 2009/0221864 | A1 * | 9/2009 | Mak | 585/803 |
| 2009/0259081 | A1 | 10/2009 | Lee et al. | |
| 2009/0266086 | A1 | 10/2009 | Lee et al. | |
| 2010/0012015 | A1 | 1/2010 | Lee et al. | |
| 2010/0122542 | A1 | 5/2010 | Choi et al. | |

FOREIGN PATENT DOCUMENTS

| | | | |
|---|---|---|---|
| EP | 0535752 | A1 | 4/1993 |
| EP | 1561683 | A1 | 8/2005 |
| JP | 46-20123 | A | 6/1971 |
| JP | 58-046299 | A | 3/1983 |
| JP | 58-072800 | A | 4/1983 |
| JP | 10-028837 | A | 2/1998 |
| JP | 2005-320311 | A | 11/2005 |
| JP | 2007-527445 | A | 9/2007 |
| KR | 10-1990-0005143 | A | 4/1990 |
| KR | 10-0184706 | B1 | 5/1999 |
| KR | 10-1999-0046828 | A | 7/1999 |
| KR | 10-2000-0011346 | A | 2/2000 |
| KR | 10-2000-0011347 | A | 2/2000 |
| KR | 10-2001-0014021 | A | 2/2001 |
| KR | 10-2001-0014033 | A | 2/2001 |
| KR | 10-0289546 | B1 | 5/2001 |
| KR | 10-2001-0049264 | A | 6/2001 |
| KR | 10-2001-0060256 | A | 7/2001 |
| KR | 10-2001-0082235 | A | 8/2001 |
| KR | 10-2001-0083920 | A | 9/2001 |
| KR | 10-2001-0088406 | A | 9/2001 |
| KR | 10-2001-0089142 | A | 9/2001 |
| KR | 10-2004-0015294 | A | 2/2004 |
| KR | 10-2004-0018265 | A | 3/2004 |
| KR | 10-2004-0046835 | A | 6/2004 |
| KR | 10-2004-0046836 | A | 6/2004 |
| KR | 10-0441857 | A | 7/2004 |
| KR | 10-0489804 | A | 5/2005 |
| KR | 10-0499710 | B1 | 7/2005 |
| KR | 10-2005-0094798 | A | 9/2005 |
| KR | 10-2005-0094799 | A | 9/2005 |
| KR | 20-0394721 | Y1 | 9/2005 |
| KR | 10-2005-0102681 | A | 10/2005 |
| KR | 10-2006-0036441 | A | 4/2006 |
| KR | 10-2006-0083727 | A | 7/2006 |
| KR | 10-0618735 | B1 | 8/2006 |
| KR | 10-0644217 | B1 | 11/2006 |
| KR | 20-0431697 | Y1 | 11/2006 |
| KR | 20-2006-0000158 | U | 12/2006 |
| KR | 10-0674451 | B1 | 1/2007 |
| KR | 10-2007-0020162 | A | 2/2007 |
| KR | 10-2007-0045172 | A | 5/2007 |
| KR | 10-2007-0084510 | A | 8/2007 |
| KR | 10-2007-0091323 | A | 9/2007 |
| KR | 10-2007-0100760 | A | 10/2007 |
| KR | 10-2009-0086916 | A | 8/2009 |
| WO | 90-00589 | A1 | 1/1990 |
| WO | 98/43029 | A1 | 10/1998 |
| WO | 98/59084 | A1 | 12/1998 |
| WO | 98/59085 | A1 | 12/1998 |
| WO | 00/23164 | A2 | 4/2000 |
| WO | 00/25061 | A1 | 5/2000 |
| WO | 02-32810 | A1 | 4/2002 |
| WO | 03/002921 | A1 | 1/2003 |
| WO | 2005-015100 | A1 | 2/2005 |
| WO | 2005/047761 | A1 | 5/2005 |
| WO | 2005/056377 | A2 | 6/2005 |
| WO | 2005/071333 | A1 | 8/2005 |

OTHER PUBLICATIONS

International Code for the Construction and Equipment of Ships Carrying Liquefied Gases in Bulk (IGC Code), 2000, Chapter 15, IMO, London.

International Search Report dated Sep. 16, 2009 of corresponding PCT Application No. PCT/KR2009/000623 filed on Feb. 11, 2008—3 pages.

Written Opinion dated Sep. 16, 2009 of corresponding PCT Application No. PCT/KR2009/000623 filed on Feb. 11, 2008—4 pages.

* cited by examiner

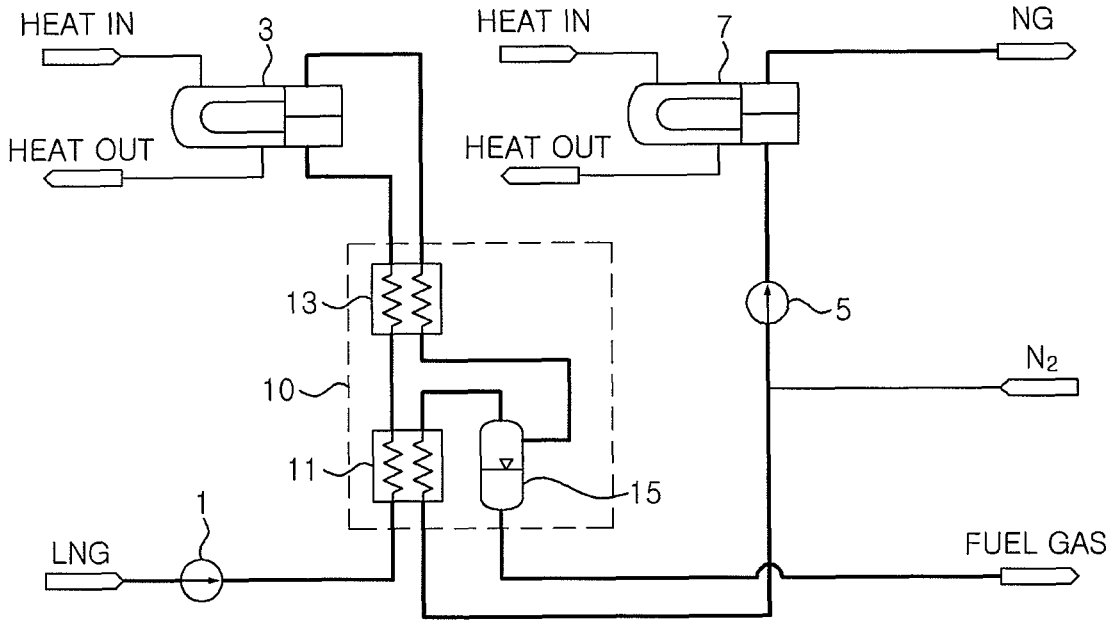
HEAT IN
3
HEAT OUT
HEAT IN
7
HEAT OUT
NG
13
10
11
15
5
N2
1
LNG
FUEL GAS

METHOD AND SYSTEM FOR REDUCING HEATING VALUE OF NATURAL GAS

CROSS-REFERENCE TO RELATED APPLICATIONS

This application claims the benefit of Korean Patent Application No. 10-2008-0033279, filed on Apr. 10, 2008, in the Korean Intellectual Property Office, the disclosure of which is incorporated herein by reference in its entirety. This application is related to and incorporates herein by reference the entire contents of the following applications:

| Title | Filing Date | application Ser. No. |
|---|---|---|
| LIQUEFIED NATURAL GAS WITH BUTANE AND METHOD OF STORING AND PROCESSING THE SAME | Jun. 27, 2008 | 12/163,742 |
| STORAGE TANK CONTAINING LIQUEFIED NATURAL GAS WITH BUTANE | Jun. 27, 2008 | 12/163,728 |

Content of application Ser. No. 12/163,742 is included in the appendix of this application. This application incorporates all the content of application Ser. No. 12/163,742.

BACKGROUND

1. Field

The present disclosure relates to a system for supplying vaporized natural gas, and more particularly, to a system for reducing a heating value of vaporized natural gas which is supplied to a user.

2. Description of the Related Technology

In recent years, the use of natural gas has rapidly expanded throughout the world. Natural gas is transported long distances in a gaseous state through a gas pipe line over land or sea, or is transported in a liquid state to consumers by liquefied natural gas (LNG) carriers. LNG is obtained by cooling natural gas into a cryogenic state (about −163° C.) where the volume of the natural gas is reduced to about 1/600 that at standard temperature and pressure, which makes it eminently suitable for long distance marine transportation.

The LNG carrier is provided for shipping and discharging the LNG when carrying it to a land destination by sea. For this purpose, the LNG carrier includes an LNG storage tank (i.e. a so-called cargo tank) capable of withstanding the cryogenic state of the LNG. Typically, the LNG carrier unloads or discharges the LNG from the LNG storage tank at a destination in the liquefied state, and the discharged LNG is gasified by LNG regasification equipment installed at the destination and is then supplied to natural gas consumers through the gas pipe line.

The land-based LNG regasification equipment is economically advantageous in the case where the equipment is installed in such a place where natural gas markets are actively and stably established to satisfy demand for natural gas. However, the land-based LNG regasification equipment is economically disadvantageous in the case where the equipment is installed in such a place where a market for natural gas is seasonal, short-term or periodic, since installation and maintenance of the LNG regasification equipment is relatively expensive.

In particular, if the LNG regasification equipment is destroyed by natural disasters or the like, even though the LNG carrier arrives at the destination to discharge the LNG, it is impossible to gasify the LNG. Therefore, there is a limit in transportation of the natural gas through the LNG carrier.

Accordingly, there has been developed a marine LNG regasification system wherein LNG regasification equipment is installed in the LNG carrier or a marine structure to gasify the LNG at sea and supply natural gas obtained by the regasification to the land. Examples of the marine structure with the LNG regasification equipment include an LNG RV (regasification vessel), an LNG FSRU (floating storage and regasification unit), etc.

Some examples of processing vaporized LNG are disclosed in U.S. Pat. No. 2,952,984, No. 3,282,060, No. 3,407,052, and the like. Further, one example of the method of adding nitrogen gas to natural gas is disclosed in U.S. Pat. No. 3,837,821.

The foregoing discussion is to provide general background information, and does not constitute of an admission of prior art.

SUMMARY

One aspect of the invention provides a method of adjusting a heating value of a vaporized natural gas comprising a first hydrocarbon component and a second hydrocarbon component. The method comprises: cooling at least part of the natural gas to liquefy at least a portion of the first component at an offshore site, wherein the first component has a heating value greater than that of the second component, wherein the heating value is measured in a unit of energy/mol; separating at least part of the liquefied portion of the first component from the natural gas at the offshore site; and mixing nitrogen to the natural gas at the offshore site.

Another aspect of the invention provides an offshore LNG plant. The offshore LNG plant comprises: an LNG containing tank; a LNG processor in fluid communication with the tank, wherein the LNG processor is configured to vaporize a supply of LNG from the tank to produce vaporized natural gas comprising a first hydrocarbon component and a second hydrocarbon component, wherein the LNG processor is further configured to remove at least part of the first component from the vaporized natural gas, wherein the first component has a heating value greater than that of the second component, wherein the heating value is measured in a unit of energy/mol, wherein the LNG processor is further configured to dilute the vaporized natural gas with a supply of $N_2$ from a $N_2$ supplier; and a pipe configured to transfer the vaporized natural gas from the LNG processor to an onshore network for supplying vaporized natural gas.

An aspect of the present invention is to provide a method and system that can reduce a heating value of natural gas composed of a variety of hydrocarbon components according to requirements of a place of demand by separating a component with a higher heating value from the natural gas to allow the separated component to be used as fuel for a generator while adding nitrogen to the natural gas to satisfy a standard heating value of the place of demand, thereby reducing the overall size and operating costs of the system.

In accordance with an aspect of the present invention, a system for reducing a heating value of natural gas is provided, including: a heat exchanger to liquefy a portion of components having high heating values by cooling natural gas; a gas-liquid separator to separate the liquefied component from the natural gas; and a nitrogen adding mechanism to add nitrogen to remaining non-liquefied components of the natural gas.

The heat exchanger may employ cold heat generated upon regasification of LNG to liquefy the portion of the components having the high heating values.

The system may further include an additional heat exchanger to cool and liquefy the remaining non-liquefied components of the natural gas after the gas-liquid separator separates the liquefied component from the natural gas.

The second heat exchanger may employ cold heat generated upon regasification of LNG to liquefy the remaining non-liquefied components of the natural gas.

The gas-liquid separator may include a separator separating a gas and a liquid from each other.

The heat exchanger and the gas-liquid separator may be integrated into a single module.

The nitrogen adding mechanism may include a nitrogen injector to inject nitrogen gas into LNG and a nitrogen valve to adjust an amount of nitrogen gas injected into the LNG. Alternatively, the nitrogen adding mechanism may include a nitrogen mixer to mix liquid nitrogen with LNG and a nitrogen valve to adjust an amount of liquid nitrogen mixed with the LNG.

The system may further include a generator using the liquefied component, separated by the gas-liquid separator, as fuel.

The system may be installed on an LNG RV (regasification vessel) or an LNG FSRU (floating storage and regasification unit), which can regasify LNG at sea.

In accordance with another aspect of the present invention, a system for reducing a heating value of natural gas is provided, including: first and second heat exchangers to partially gasify LNG carried to a place of demand after sequentially receiving and heating the LNG; a first vaporizer to completely gasify the partially gasified LNG, the second heat exchanger liquefying a portion of components having high heating values by cooling the completely gasified LNG; a separator to separate the liquefied component to reduce the heating value of the natural gas, the first heat exchanger liquefying remaining non-liquefied components of the LNG by cooling the LNG; and a nitrogen adding mechanism to add nitrogen to the cooled LNG to satisfy a desired heating value at a place of demand by further reducing the heating value of the natural gas.

In accordance with a further aspect of the present invention, a method for reducing a heating value of natural gas is provided, including: separating a portion of components having high heating values from the natural gas to reduce the heating value of the natural gas; and adding nitrogen to the natural gas, from which the portion of the components having the high heating values has been separated, to further reduce the heating value of the natural gas.

The method may further include: supplying the portion of the components separated from the natural gas as fuel.

The separating of a portion of components having higher heating values may include liquefying the portion of the component having the high heating value by cooling the natural gas, and separating the liquefied portion of the component from the natural gas.

In accordance with yet another aspect of the present invention, a method for reducing a heating value of natural gas is provided, including: partially gasifying LNG carried to a place of demand by sequentially supplying the LNG to first and second heat exchangers to heat the LNG; completely gasifying the partially gasified LNG with a first vaporizer; partially liquefying a portion of components of the LNG having high heating values by supplying the completely gasified LNG to the second heat exchanger to cool the completely gasified LNG; separating the liquefied component from the gasified LNG with a separator to reduce the heating value of the natural gas; supplying gaseous components of the LNG to the first heat exchanger to cool and liquefy the gaseous components of the LNG; and adding nitrogen to the cooled LNG to satisfy a desired heating value of the place of demand by further reducing the heating value of the natural gas.

In accordance with yet another aspect of the present invention, a method for reducing a heating value of natural gas in a floating marine structure with LNG regasification equipment and a generator is provided, the method including: separating a component having a high heating value from the natural gas to reduce the heating value of the natural gas; and using the separated component having the high heating value as fuel for the generator.

The method may further include: adding nitrogen to the natural gas, from which the component having the high heating value has been separated, to further reduce the heating value of the natural gas.

In accordance with yet another aspect of the present invention, a method for reducing a heating value of natural gas in a floating marine structure with LNG regasification equipment and a generator is provided, the method including: separating a component having a high heating value from the natural gas to reduce the heating value of the natural gas; and adding nitrogen to the natural gas, from which the component having the high heating value has been separated, to further reduce the heating value of the natural gas, wherein a separated amount of the component having the high heating value is equal to an amount of fuel to be used for the generator.

The marine structure may be one selected from an LNG RV and an LNG FSRU.

As described above, aspects of the present invention provide method and system that can reduce a heating value of natural gas composed of a variety of hydrocarbon components according to requirements of a place of demand by separating components with higher heating values from the natural gas to allow the separated components to be used as fuel for a generator while adding nitrogen to the natural gas to satisfy the standard heating value of the place of demand, thereby reducing the overall size and operating costs of the system.

Therefore, the method and system according to an embodiment of the present invention can prevent an excessive increase of the ratio of nitrogen in natural gas components supplied to the place of demand and can reduce operating costs of the system even at sea where satisfactory supply of nitrogen cannot be obtained.

Further, the method and system according to an embodiment of the present invention eliminates a separate storage tank and other associated devices for storing components (for example, ethane, propane, butane, etc.) in a liquid state, which is separated from natural gas to reduce a heating value of the natural gas, thereby preventing an increase in overall size of the system.

BRIEF DESCRIPTION OF THE DRAWINGS

The above and other aspects, features and advantages of the present invention will become apparent from the following description of preferred embodiments given in conjunction with the accompanying drawing, in which:

FIG. 1 is a conceptual view of a system for reducing a heating value of natural gas according to one embodiment of the present invention.

DETAILED DESCRIPTION OF EMBODIMENTS

Various embodiments of the present invention will be described in detail with reference to the accompanying drawing hereinafter. FIG. 1 is a conceptual view of a system for reducing a heating value of natural gas or vaporized LNG (liquefied natural gas) according to one embodiment of the present invention.

Generally, natural gas is supplied to consumers through regasification of LNG, and heating value thereof is adjusted depending on regional conditions before supply of natural gas thereto. If LNG carried to a certain place of demand has a higher heating value than the standard of the place of demand, an adequate amount of nitrogen gas is added to the LNG or remove a component having a high heating value from the LNG. Further, if the LNG has a lower heating value than the standard of the place of demand, it is necessary to add an LPG component (that is, a hydrocarbon component with a high heating value), separated before transportation, to the LNG.

As a method for reducing a heating value of natural gas, a method of adding an inert gas such as nitrogen gas to the natural gas, a method of separating components having high heating values from the natural gas, or the like is used. On the other hand, as a method for increasing the heating value of the natural gas, a method of adding a component with a high heating value to the natural gas or the like is used.

Since natural gas generally has a high heating value immediately after being produced than that required for the place of demand, the method for reducing the heating value of the natural gas is generally used. In the method of separating the components having the high heating values from the natural gas for reduction of the heating value, hydrocarbon components (ethane, propane, butane, etc.) with higher heating values among a variety of hydrocarbon components contained in the natural gas, such as methane ($C_1$), ethane, propane and butane ($C_2$~$C_4$), are separated from the natural gas.

When only the method of adding nitrogen gas is used for reduction of the heating value of the natural gas, the ratio of nitrogen in the components of the natural gas supplied to consumers can be excessively increased. Typically, it is desirable that the ratio of nitrogen in the components of the natural gas be maintained within 3%. Further, when this operation is carried out on a marine structure such as an LNG FSRU or the like due to a great consumption amount of nitrogen, operating costs of a system for performing the method can be increased due to inefficient supply of nitrogen or direct production of nitrogen at sea.

Additionally, when using the method of separating the components (ethane, propane, butane, etc.) having the higher heating values from the natural gas for reduction of the heating value of the natural gas, it is necessary to provide a separate storage tank and other associated devices for storing the components separated from the natural gas in a liquid state, thereby increasing the overall size of the system while complicating operation thereof.

One embodiment of the invention provides a method of adjusting a heating value of a vaporized natural gas (vaporized LNG) comprising a first hydrocarbon component and a second hydrocarbon component. The method comprises cooling at least part of the natural gas to liquefy at least a portion of the first component at an offshore site, wherein the first component has a heating value greater than that of the second component, wherein the heating value is measured in a unit of energy/mol; separating at least part of the liquefied portion of the first component from the vaporized natural gas at the offshore site; and mixing nitrogen to the vaporized natural gas at the offshore site. In one embodiment, the offshore site comprises an LNG RV or an LNG FSRU.

In one embodiment of the foregoing method, the first hydrocarbon component is propane. In another embodiment, the first hydrocarbon component is butane. In certain embodiments, the second hydrocarbon component is methane. In some embodiments, at least part of both propane and butane contained in vaporized natural gas is liquefied and separated form the vaporized natural gas. In one embodiments, even after separation of at least part of the liquefied portion of the first component, the vaporized natural gas still contains a portion of the first component, for example, propane and butane.

In one embodiment of the foregoing method, the first hydrocarbon component is ethane, and the second hydrocarbon component is methane. In the foregoing embodiment, even after separation of at least part of the liquefied portion of the first component, the vaporized natural gas may still contain a portion of the first component, for example, ethane.

In one embodiment of the foregoing method, the separated portion of the first component is burned at the offshore site for the various uses, for example, providing heat to the offshore site, for producing electricity to be used at the offshore site. In one embodiment, the offshore site does not have a tank for storing the separated portion of the first component. In another embodiment, the offshore site does not have any output port or valve which is configured to provide a connection to another offshore structure, a ship, an onshore port or an onshore valve. In one embodiment, the offshore site does not have a nitrogen ($N_2$) generator configured to separate $N_2$ from air to a predetermined level of concentration.

One embodiment of the invention provides an offshore LNG plant. The offshore LNG plant comprises an LNG containing tank; a LNG processor in fluid communication with the tank, wherein the LNG processor is configured to vaporize a supply of LNG from the tank to produce vaporized natural gas comprising a first hydrocarbon component and a second hydrocarbon component, wherein the LNG processor is further configured to remove at least part of the first component from the vaporized natural gas, wherein the first component has a heating value greater than that of the second component, wherein the heating value is measured in a unit of energy/mol, wherein the LNG processor is further configured to dilute the vaporized natural gas with a supply of $N_2$ from a $N_2$ supplier; and a pipe configured to transfer the vaporized natural gas from the LNG processor to an onshore network for supplying vaporized natural gas. In one embodiment, the offshore LNG plant is located within a floating system or ship. The floating system or ship may be able to engage with a mooring structure fixed to the seabed. In one embodiment, the floating system or ship comprises one of an LNG RV and an LNG FSRU.

Another embodiment of the invention provides an offshore LNG plant. The offshore LNG plant comprises an LNG containing tank; a vaporizer configured to vaporize a supply of LNG from the tank to produce vaporized natural gas comprising a first hydrocarbon component and a second hydrocarbon component, a separator configured to separate at least part of the first component from the vaporized natural gas, wherein the first component has a heating value greater than that of the second component, wherein the heating value is measured in a unit of energy/mol, an $N_2$ mixer configured to dilute the vaporized natural gas with a supply of $N_2$ from a $N_2$ supplier; and a pipe configured to transfer the vaporized natural gas from the LNG processor to an onshore network for supplying vaporized natural gas. In one embodiment, the offshore LNG plant is a floating system or ship. The floating system or ship can be engaged with a mooring structure fixed to the seabed. In one embodiment, the floating system or ship comprises one of an LNG RV and an LNG FSRU.

In one embodiment of the foregoing plant, the first hydrocarbon component is propane. In another embodiment, the first hydrocarbon component is butane. In certain embodiments, the second hydrocarbon component is methane. In some embodiments, at least part of both propane and butane contained in vaporized natural gas is liquefied and separated form the vaporized natural gas. In one embodiments, even after separation of at least part of the liquefied portion of the first component, the vaporized natural gas still contains a portion of the first component, for example, propane and butane.

In one embodiment of the foregoing plant, the first hydrocarbon component is ethane, and the second hydrocarbon component is methane. In the foregoing embodiment, even after separation of at least part of the liquefied portion of the first component, the vaporized natural gas may still contain a portion of the first component, for example, ethane.

In one embodiment of the foregoing plant, the separated portion of the first component is burned at the offshore plant for the various uses, for example, providing heat to the offshore plant, for producing electricity to be used at the offshore plant. In one embodiment, the offshore plant has a burner and the separated portion of the first component is vaporized before sending to a burner. In one embodiment, the ship or floating system having the offshore plant does not have a tank for storing the separated portion of the first component. In another embodiment, the offshore plant does not have any output port or valve which is configured to provide a connection to another offshore structure, a ship, an onshore port or an onshore valve. In one embodiment, the offshore plant does not have a nitrogen ($N_2$) generator configured to separate $N_2$ from air to a predetermined level of concentration. The floating system or ship comprises an input valve or port which can be connected a valve or port in another ship configured to supply $N_2$.

According to one embodiment of the present invention, a method for reducing a heating value of natural gas includes separating a portion of components having higher heating values from LNG, which is carried in a cargo tank and is then regasified or vaporized for supply to a place of demand, and adding nitrogen to the LNG to satisfy a standard heating value of the place of demand.

Referring to FIG. 1, the LNG carried from the cargo tank (not shown) is compressed to a lower pressure of about 20 bars by an LNG low pressure pump 1. Then, the compressed LNG is heated and partially gasified while passing through first and second heat exchangers 11 and 13. The partially gasified LNG is completely gasified by a low pressure LNG vaporizer 3 and is then supplied to the second heat exchanger 13.

The regasified or vaporized LNG is partially condensed by cold heat in the second heat exchanger 13, in which condensed components of the LNG have high heating values. Generally, the higher the heating value, i.e. the greater the number of carbon elements in a hydrocarbon molecule, the higher the liquefaction temperature, causing a component having a higher heating value to be condensed prior to other components having lower heating values.

With components of high heating values condensed, the LNG is supplied to a separator 15, which separates the condensed components from the LNG to use the separated components as fuel for a generator and the like. At this time, according to an embodiment of the present invention, the liquid components separated by the separator 15 are all used as fuel for the generator and the like, and, for this reason, it is desirable to adjust a condensed amount of components such that the components of the high heating values can be condensed in the second heat exchanger 13 by an amount to be used as fuel. In other words, according to this embodiment, the components of the high heating values are not completely separated from the LNG until the regasified LNG meets a standard heating value of a place of demand, but are partially separated only by the amount to be used as the fuel.

As such, an embodiment of the present invention enables a portion of the components having the high heating values to be separated from natural gas and to be completely consumed as fuel for the generator and the like, thereby eliminating requirement for a separate storage tank or other associated devices for storing the liquid components separated from the natural gas.

In case where components having high heating values such as butane and propane are separated and sold as LPG, and there is a need to precisely separate such LPG components. For this purpose, a device such as a column is used. However, according an embodiment of to the present invention, the components having the high heating values are separated from the LNG and are internally used as fuel for the generator and the like of a marine structure, thereby eliminating the need to precisely separate the components such as butane, propane, and the like. As a result, an embodiment of the present invention provides an advantage of easily separating the components of the high heating values from the LNG with the separator 15 which has a relatively simple configuration.

Meanwhile, after the liquid components are separated by the separator 15, remaining gaseous component of the LNG are all supplied to the first heat exchanger 11 and are condensed thereby. Here, since the components having the high heating values are separated as described above, the total heating value of the condensed LNG is relatively reduced but may still be higher than the standard heating value of the place of demand. Accordingly, nitrogen is added to precisely meet the standard heating value of the place of demand.

Here, nitrogen can be added in a gaseous state or in a liquid state to the LNG. If nitrogen gas is added to the LNG, a nitrogen adding mechanism of the system may include a nitrogen injector (not shown) for injecting the nitrogen gas into the LNG in a liquid state, and a nitrogen valve (not shown) for adjusting an amount of nitrogen injected into the LNG. Alternatively, if liquid nitrogen is added to the LNG in a liquid state, the nitrogen adding mechanism may include a nitrogen mixer (not shown) for mixing the liquid nitrogen with the LNG, and a nitrogen valve (not shown) for adjusting an added amount of liquid nitrogen. The added amount of nitrogen can be precisely adjusted by controlling opening/closing of the nitrogen valve with a controller (not shown) and the like.

The nitrogen injector, nitrogen mixer, and nitrogen valve may have any configurations as long as they can add nitrogen into the LNG.

According to an embodiment of the present invention, the added amount of nitrogen is significantly lower than that of the other technique wherein the heating value of natural gas is adjusted only by addition of nitrogen, thereby remarkably reducing nitrogen consumption. As a result, the method and system of embodiments of the present invention have an advantageous effect of enabling satisfactory adjustment of the heating value without a separate nitrogen producing apparatus or with only a nitrogen producing apparatus of a small capacity at sea where supply of nitrogen cannot be efficiently performed. As such, the system of an embodiment of the present invention can be operated at reduced cost by lowering consumption of expensive nitrogen.

The first and second heat exchangers 11 and 13, and the separator 15 may constitute a cold box 10 as a single module. Since the first and second heat exchangers 1 and 13, and the separator 15 is maintained in a cryogenic state, integration of these components into the single module can provide advantages in view of thermal efficiency and the like by reducing the length of a pipe between the components.

After being adjusted to have a desired heating value by addition of nitrogen, the LNG is compressed to a high pressure of about 70~130 bars by an LNG high pressure pump 5, regasified by a high pressure LNG vaporizer 7, and is then supplied to the place of demand.

The system for reducing the heating value of natural gas according to an embodiment of the present invention can be provided to a marine structure, such as an LNG RV, an LNG FSRU, etc., where supply of nitrogen cannot be efficiently performed. The LNG RV is a floating LNG carrier that has LNG regasification equipment and is seafaring. The LNG FSRU is a floating marine structure that can store LNG, unloaded from an LNG carrier, in a cargo tank at sea a long distance from the land to gasify the LNG as needed, thereby supplying the regasified LNG to consumers on the land.

The system for reducing the heating value of natural gas according an embodiment of to the present invention can also be provided to a land structure so long as it has the LNG regasification equipment. Furthermore, the system for reducing the heating value of natural gas according to an embodiment of the present invention can be provided to other marine structure as well as the marine structures such as the LNG RV, the LNG FSRU, etc.

Although the method and system for reducing the heating value of natural gas have been described with reference to the embodiments and the accompanying drawings, the present invention is not limited thereto. It should be understood that various modifications and changes can be made by those skilled in the art without departing from the spirit and scope of the present invention as defined by the accompanying claims.

What is claimed is:

1. A Ship comprising: a natural gas tank containing liquefied natural gas (LNG); a vaporizer connected to the tank and configured to gasify LNG from the tank to produce vaporized natural gas; a first heat exchanger connected to the vaporizer and configured to receive and heat exchange at least part of the vaporized natural gas, thereby liquefying a portion thereof, wherein the first heat exchanger employs cold heat generated upon regasification of the LNG to liquefy the portion of the vaporized natural gas; a gas-liquid separator connected to the first heat exchanger and configured to separate a liquefied portion from the heat exchanged natural gas;

a second heat exchanger connected to the gas-liquid separator and configured to receive and heat exchange at least part of the remainder of the heat exchanged natural gas after the gas-liquid separator separates the liquefied portion from the heat exchanged natural gas, wherein the second heat exchanger employs cold heat generated upon regasification of the LNG to liquefy the remainder; a first output of the gas-liquid separator configured to supply all the liquefied portion to at least one combustion device of the ship such that all of the liquefied portion is consumed in the ship; a second output of the gas-liquid separator configured to supply at least part of the remainder of the heat exchanged natural gas to a nitrogen adding mechanism; and the nitrogen adding mechanism configured to receive the at least part of the remainder and add nitrogen thereto.

2. The ship according to claim 1, wherein the first heat exchanger and the gas-liquid separator are integrated into a single module.

3. The system according to claim 1, wherein the nitrogen adding mechanism comprises a nitrogen injector to inject nitrogen gas and a nitrogen valve to adjust an amount of nitrogen gas to be injected.

4. The system according to claim 1, wherein the nitrogen adding mechanism comprises a nitrogen mixer to mix liquid nitrogen and a nitrogen valve to adjust an amount of liquid nitrogen to be mixed.

5. The system according to claim 1, wherein the at least one combustion device comprises a generator or engine configured to consume the liquefied portion as fuel.

6. A ship comprising: a natural gas tank containing liquefied natural gas (LNG); first and second heat exchangers configured to partially gasify the LNG from the tank; a first vaporizer configured to further vaporize the partially gasified LNG to produce vaporized natural gas; the second heat exchanger connected the first vaporizer and further configured to receive and heat exchange at least part of the vaporized natural gas, thereby liquefying a portion thereof; a separator connected to the second heat exchanger and configured to separate a liquefied portion from the natural gas heat exchanged in the second heat exchanger; a first output of the gas-liquid separator configured to supply all the liquefied portion to at least one combustion device of the ship such that all the liquefied portion is consumed in the ship; a second output of the gas-liquid separator configured to feed at least part of the remainder of the heat exchanged natural gas to the first heat exchanger; the first exchanger configured to liquefy at least part of the remainder; and a nitrogen adding mechanism configured to receive the at least part of the remainder and add nitrogen thereto.

7. A method for processing natural gas in the ship of claim 6, the method comprising: heat exchanging, at the second heat exchanger, vaporized natural gas, thereby liquefying the portion of the vaporized natural gas; separating, at the separator, the liquefied portion form the heat exchanged natural gas; supplying, through the first output of the gas-liquid separator, all the liquefied portion to the at least one combustion device of the ship such that all the liquefied portion is consumed in the ship; supplying, through the second output of the gas-liquid separator, the at least part of the remainder of the heat exchanged natural gas to the nitrogen adding mechanism; and adding, at the nitrogen adding mechanism, the nitrogen to the at least part of the remainder.

8. The method according to claim 7, wherein the at least one combustion device comprises a generator or engine configured to consume the liquefied portion as fuel.

9. The ship of claim 1, wherein the ship does not comprise a processor configured to additionally divide the liquefied portion into two or more hydrocarbon components.

10. The ship of claim 1, wherein the ship does not comprises another tank configured to store at least a portion of the liquefied portion.

11. The ship of claim 1, wherein the LNG in the tank comprises butane and the liquefied portion comprises butane.

* * * * *